US007538672B2

(12) United States Patent
Lockyer et al.

(10) Patent No.: US 7,538,672 B2
(45) Date of Patent: May 26, 2009

(54) METHOD AND APPARATUS FOR CAPACITIVE SENSING OF DOOR POSITION

(75) Inventors: Richard D. Lockyer, Saratoga, CA (US); David H. Beauley, Sunnyvale, CA (US)

(73) Assignee: Savi Technology, Inc., Mountain View, CA (US)

( * ) Notice: Subject to any disclaimer, the term of this patent is extended or adjusted under 35 U.S.C. 154(b) by 394 days.

(21) Appl. No.: 11/336,402

(22) Filed: Jan. 20, 2006

(65) Prior Publication Data

US 2007/0096904 A1 May 3, 2007

Related U.S. Application Data

(60) Provisional application No. 60/732,240, filed on Nov. 1, 2005.

(51) Int. Cl.
*G08B 13/08* (2006.01)

(52) U.S. Cl. ..... 340/545.6; 340/562; 340/572.8

(58) Field of Classification Search ..... 340/545.1, 340/545.4, 545.6, 572.1, 572.8, 539.1, 562; 324/658, 663, 671; 345/173, 174
See application file for complete search history.

(56) References Cited

U.S. PATENT DOCUMENTS

| | | | | |
|---|---|---|---|---|
| 3,561,634 | A | 2/1971 | Meldrum | |
| 3,597,753 | A | 8/1971 | Tabankin | |
| 3,665,449 | A | 5/1972 | Elder et al. | |
| 3,848,243 | A | 11/1974 | Schirmer | |
| 3,878,539 | A | 4/1975 | Gooding | |
| 3,961,323 | A | 6/1976 | Hartkorn | |
| 4,074,184 | A * | 2/1978 | Dechene et al. | 324/663 |
| 4,258,359 | A | 3/1981 | McLamb | |
| 4,438,428 | A | 3/1984 | Ober et al. | |
| 4,484,181 | A | 11/1984 | Schwartz | |
| 4,683,461 | A | 7/1987 | Torre | |
| 4,688,244 | A | 8/1987 | Hannon et al. | |
| 4,808,974 | A | 2/1989 | Cantley | |
| 5,072,212 | A | 12/1991 | Sorenson | |

(Continued)

FOREIGN PATENT DOCUMENTS

EP 0 467 036 A2 1/1992

(Continued)

OTHER PUBLICATIONS

Roderick E. Thorne, Philip J. Keleshian, Timothy R. Redler, Joseph S.Chan and Nikola Cargonja, U.S. Appl. No. 60/332,480, filed Nov. 9, 2001 for "Method and Apparatus for Providing Container Security with a Tag".

(Continued)

*Primary Examiner*—Thomas J Mullen
(74) *Attorney, Agent, or Firm*—Haynes and Boone, LLP

(57) ABSTRACT

An apparatus has a sensor with an electrically conductive ground member, electrically conductive first and second parts spaced from and proximate to each other and the ground member, and an insulator disposed between the ground member and the first and second parts. A different configuration involves a tag having circuitry, and a sensor supported on the tag and having electrically conductive first and second parts that are spaced from and proximate to each other, the first and second parts each being electrically coupled to the circuitry.

31 Claims, 3 Drawing Sheets

U.S. PATENT DOCUMENTS

| | | | | |
|---|---|---|---|---|
| 5,247,279 | A | 9/1993 | Sato | |
| 5,341,123 | A | 8/1994 | Schuman, Sr. et al. | |
| 5,410,899 | A | 5/1995 | McConnell | |
| 5,422,627 | A | 6/1995 | Tap et al. | |
| 5,448,220 | A | 9/1995 | Levy | |
| 5,479,152 | A | 12/1995 | Walker et al. | |
| 5,499,014 | A | 3/1996 | Greenwaldt | |
| 5,568,951 | A | 10/1996 | Morgan | |
| 5,572,191 | A | 11/1996 | Lundberg | |
| 5,615,247 | A | 3/1997 | Mills | |
| 5,646,592 | A | 7/1997 | Tuttle | |
| 5,656,996 | A | 8/1997 | Houser | |
| 5,729,199 | A | 3/1998 | Cooper et al. | |
| 5,735,495 | A | 4/1998 | Kubota | |
| 5,804,810 | A | 9/1998 | Woolley et al. | |
| 5,844,482 | A | 12/1998 | Guthrie et al. | |
| 5,907,812 | A | 5/1999 | Van De Berg | |
| 5,913,180 | A | 6/1999 | Ryan | |
| 5,917,433 | A | 6/1999 | Keillor et al. | |
| 5,936,523 | A | 8/1999 | West | |
| 5,939,982 | A | 8/1999 | Gagnon et al. | |
| 5,959,568 | A | 9/1999 | Woolley | |
| 5,999,091 | A | 12/1999 | Wortham | |
| 6,204,764 | B1 * | 3/2001 | Maloney | 340/572.1 |
| 6,236,911 | B1 | 5/2001 | Kruger | |
| 6,271,753 | B1 | 8/2001 | Shukla | |
| 6,274,856 | B1 | 8/2001 | Clothier et al. | |
| 6,281,793 | B1 | 8/2001 | Haimovich et al. | |
| 6,285,282 | B1 * | 9/2001 | Dorenbosch et al. | 340/572.1 |
| 6,346,886 | B1 | 2/2002 | De La Huerga | |
| 6,444,961 | B2 | 9/2002 | Clothier et al. | |
| 6,483,473 | B1 | 11/2002 | King et al. | |
| 6,497,656 | B1 | 12/2002 | Evans et al. | |
| 6,512,455 | B2 | 1/2003 | Finn et al. | |
| 6,608,554 | B2 | 8/2003 | Lesesky et al. | |
| 6,736,316 | B2 | 5/2004 | Neumark | |
| 6,744,352 | B2 | 6/2004 | Lesesky et al. | |
| 6,747,558 | B1 * | 6/2004 | Thorne et al. | 340/545.6 |
| 6,748,292 | B2 | 6/2004 | Mountz | |
| 6,753,775 | B2 | 6/2004 | Auerbach et al. | |
| 6,796,142 | B2 | 9/2004 | Burn | |
| 6,844,829 | B2 | 1/2005 | Mayor | |
| 6,919,803 | B2 | 7/2005 | Breed | |
| 6,975,224 | B2 | 12/2005 | Galley, III et al. | |
| 7,023,348 | B2 | 4/2006 | Hogan et al. | |
| 7,034,683 | B2 | 4/2006 | Ghazarian | |
| 7,042,354 | B2 | 5/2006 | Auerbach et al. | |
| 7,091,864 | B2 | 8/2006 | Veitch et al. | |
| 7,098,784 | B2 | 8/2006 | Easley et al. | |
| 7,132,926 | B2 | 11/2006 | Vaseloff et al. | |
| 7,242,296 | B2 * | 7/2007 | Wang et al. | 340/545.6 |
| 7,321,308 | B1 | 1/2008 | Feibelman | |
| 7,333,019 | B2 | 2/2008 | Redler et al. | |
| 2004/0012502 | A1 | 1/2004 | Rasmussen | |
| 2004/0069850 | A1 | 4/2004 | De Wilde | |
| 2004/0119588 | A1 * | 6/2004 | Marks | 340/539.1 |
| 2004/0174259 | A1 | 9/2004 | Peel et al. | |
| 2004/0183673 | A1 | 9/2004 | Nageli | |
| 2004/0226800 | A1 * | 11/2004 | Pierga et al. | 340/686.5 |
| 2004/0233041 | A1 | 11/2004 | Bohman et al. | |
| 2004/0263329 | A1 | 12/2004 | Cargonja et al. | |
| 2005/0134457 | A1 | 6/2005 | Rajapakse et al. | |
| 2005/0151643 | A1 | 7/2005 | Rajapakse et al. | |
| 2006/0012481 | A1 | 1/2006 | Rajapakse et al. | |
| 2006/0290496 | A1 * | 12/2006 | Peeters | 340/572.1 |

FOREIGN PATENT DOCUMENTS

| | | |
|---|---|---|
| EP | 0 825 554 A1 | 2/1998 |
| EP | 0 984 400 A2 | 3/2000 |
| WO | WO 98 / 32092 | 7/1998 |
| WO | WO 01 / 08116 | 2/2001 |
| WO | WO 01 / 27891 | 4/2001 |

OTHER PUBLICATIONS

Nikola Cargonja, Philip J. Keleshian, Roderick E. Thorne and Steven J. Farrell, U.S. Appl. No. 60/464,067, filed Apr. 18, 2003 for "Techniques for Detecting Intrusion Into a Cargo Container".

Nikola Cargonja, Philip J. Keleshian, Roderick E. Thorne and Ravindra U. Rajapakse, U.S. Appl. No. 60/496,056, filed Aug. 18, 2003 for "Technique Using Cargo Container Motion as a Factor in Intrusion Detection".

Gustavo Padilla and Roderick E. Thorne, U.S. Appl. No. 60/504,580, filed Sep. 19, 2003 for "Technique Using Cargo Container Door Sensor as a Factor In Intrusion Detection".

Nicholas D. Cova, Mark S. Weidick, and Blair B. LaCorte, U.S. Appl. No. 60/518,553, filed Nov. 7, 2003 for "Method and Apparatus for Increased Container Security".

Ravindra U. Rajapakse, Roderick E. Thorne, Robert Fraser Jennings, Steven J. Farrell and Liping Julia Zhu, U.S. Appl. No. 60/588,229, filed Jul. 15, 2004 for "Method And Apparatus for Effecting Control or Monitoring Within a Container".

Nicholas D. Cova, Mark S. Weidick and Blair B. LaCorte, U.S. Appl. No. 10/984,026, filed Nov. 8, 2004 for "Method and Apparatus for Increased Container Security".

Ravindra U. Rajapakse, Steven J. Farrell, Nicholas D. Cova, Mark S. Weidick, Roderick E. Thorne and Gustavo Padilla, U.S. Appl. No. 60/514,968, filed Oct. 27, 2003 for "Mechanisms for Secure RF Tags on Containers".

Steven J. Farrell, Blair B. LaCorte, and Ravindra U. Rajapakse, U.S. Appl. No. 11/158,300, filed Jun. 21, 2005 for "Method and Apparatus for Monitoring Mobile Containers".

Nikola Cargonja, Timothy R. Redler, Richard D. Lockyer and Kent G. Merritt, U.S. Appl. No. 11/266,018, filed Nov. 3, 2005 for "Method and Apparatus for Monitoring the Voltage of a Battery".

Richard D. Lockyer, U.S. Appl. No. 60/732,240, filed Nov. 1, 2005 for "Apparatus and Method for Capacitive Sensing of Door Position".

* cited by examiner

METHOD AND APPARATUS FOR CAPACITIVE SENSING OF DOOR POSITION

This application claims the priority under 35 U.S.C. §119 of U.S. provisional application No. 60/732,240 filed Nov. 1, 2005, the disclosure of which is hereby incorporated herein by reference.

FIELD OF THE INVENTION

This invention relates in general to monitoring techniques and, more particularly, to techniques for monitoring a metal part such as a door of a shipping container.

BACKGROUND

A variety of different products are shipped in cargo containers. Products are packed into a container by a shipper, after which the container doors are closed and then secured with some type of lock or seal. The container is then transported to a destination, where a recipient removes the lock and unloads the container.

The shipper often finds it advantageous to have some form of monitoring while the container is being transported. For example, the cargo within the container may include relatively valuable products such as computers or other electronic devices, and thieves may attempt to break into the container and steal these products if the container is left unattended during transport. It is not cost-feasible to have a person watch a container at all times in order to provide security and/or monitoring. Accordingly, electronic systems have previously been developed to provide a degree of automated security and/or monitoring. Although these pre-existing systems have been generally adequate for their intended purposes, they have not been satisfactory in all respects.

As one example, mechanical door sensors have previously been used to monitor a door of a shipping container, in order to verify that the door remains closed during transport. Mechanical door sensors typically have at least one part (such as a shaft or plunger) that moves when a container door is opened or closed. In some applications, the moving part has to be hermetically sealed before it enters an enclosure containing sensing electronics. Vandals or terrorists may attempt to defeat a mechanical sensor by locking the moving part in place, for example with an epoxy adhesive, or a drill bit. If the movable part is no longer able to move, it cannot detect a situation where the door is opened.

SUMMARY OF THE INVENTION

One broad form of the invention involves a sensor that includes: an electrically conductive ground member; electrically conductive first and second parts spaced from and proximate to each other and the ground member; and an insulator disposed between the ground member and the first and second parts.

A different broad form of the invention involves a tag having circuitry; and a sensor supported on said tag and having electrically conductive first and second parts that are spaced from and proximate to each other, said first and second parts each being electrically coupled to said circuitry.

Another broad form of the invention involves monitoring an electrical characteristic between electrically conductive first and second parts that are spaced from and proximate to each other and an electrically conductive ground member, where an insulator is disposed between the ground member and the first and second parts.

Still another broad form of the invention relates to a tag having thereon a sensor with electrically conductive first and second parts that are spaced from and proximate to each other and that are electrically coupled to circuitry within the tag. This form of the invention involves monitoring an electrical characteristic between the electrically conductive first and second parts using the circuitry in the tag.

BRIEF DESCRIPTION OF THE DRAWINGS

A better understanding of the present invention will be realized from the detailed description that follows, taken in conjunction with the accompanying drawings, in which.

DETAILED DESCRIPTION

Figure 1:
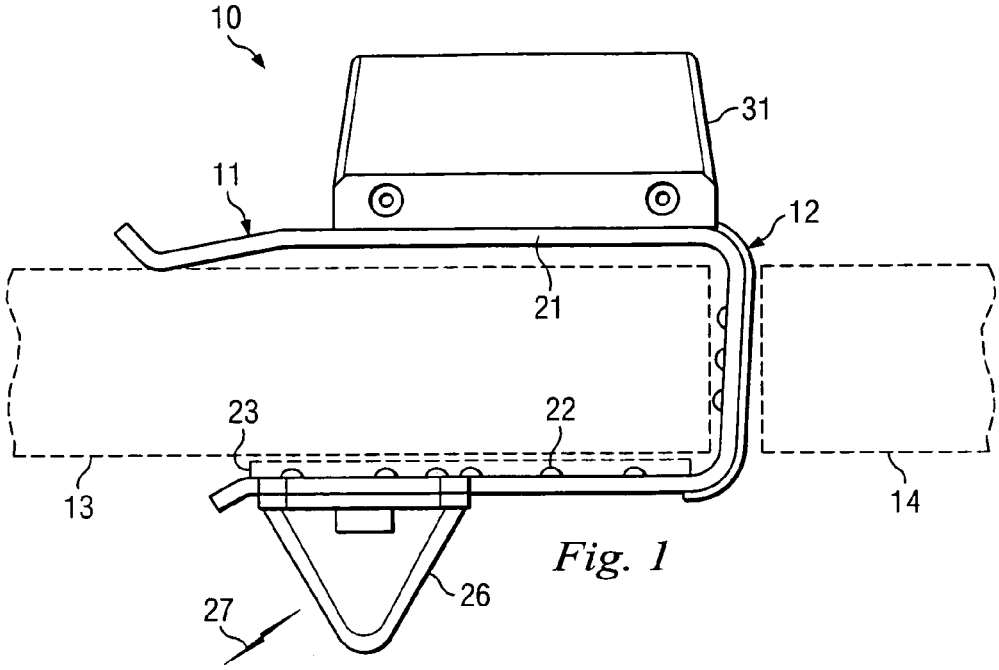
FIG. 1 is a diagrammatic top view of an apparatus that embodies aspects of the invention, and that includes a radio frequency identification tag, a sensor supported on the tag, and two movable doors of a shipping container.

FIG. 1 is a diagrammatic top view of an apparatus 10 that includes a radio frequency identification (RFID) tag 11, a sensor 12 supported on the tag, and two movable doors 13 and 14. In FIG. 1, the tag 11 is removably supported on an edge of the door 13. The doors 13 and 14 can each move between open and closed positions. FIG. 1 shows each of the doors 13 and 14 in the closed position.

In the disclosed embodiment, the doors 13 and 14 are part of a conventional shipping container of a well-known type that conforms to standards set by the International Organization for Standardization (ISO). More specifically, the container complies with an industry-standard specification known as an ISO 668:1995(E) Series 1 freight container. The vast majority of containers that are currently in commercial use conform to this ISO standard. As is standard for this type of container, the doors 13 and 14 are each made of metal. The door 14 has a rubber door gasket with both conductive and polar properties. This door gasket and a metal strap are riveted to an edge of the door 14. When the doors 13 and 14 are both closed, the gasket and metal strap are not readily accessible from outside the container. The ISO 668:1995(E) Series 1 container is mentioned by way of example. The present invention is not limited to this particular type of container, or containers in general.

The tag 11 includes a resilient metal support clip 21 that is a single integral part and that is bent to have approximately a C-shape. The inner surface of the clip 21 has several bosses 22. The bosses 22 serve as gripping structure that helps resist movement of the support clip 21 relative to the edge of the door 13. In particular, the bosses 22 resist detachment of the support clip 21 from the container door 13 due to horizontal movement in a rightward direction in FIG. 1, or due to vertical downward sliding movement of the support clip 21 along the edge of the door 13. In addition to the bosses 22, or in place of the bosses 22, it would alternatively be possible to provide a gripping structure in the form of a non-slip sheet 23 that is securely mounted to one or more of the inner surfaces of the support clip 21. The sheet 23 could, for example, be made of rubber or some other suitable non-slip material.

The tag 11 includes a wireless communication module 26 that is fixedly mounted to the outer end of one leg of the C-shaped support clip 21. The module 26 includes a housing that has an antenna therein, and the antenna can be used to transmit and receive wireless signals, for example as shown diagrammatically at 27. The wireless communication module 26 may also have within its housing some support circuitry for the antenna. When the tag 11 is removably supported on the container door 13, the wireless communication module 26 is on the exterior side of the door 13.

The tag 11 also includes a control module 31 that is fixedly mounted on the leg of the clip 21 opposite from the leg with the wireless communication module 26. When the tag 11 is mounted on the container door 13, and when the container door 13 is in its closed position, the control module 31 is disposed in the interior of the container. The control module 31 contains control circuitry of the tag 11. The control circuitry within the control module 31 is electrically coupled to the antenna and any other circuitry within the wireless communication module 26, in a manner discussed later.

The sensor 12 is fixedly mounted on the bight of the C-shaped support clip 21. As mentioned above, FIG. 1 shows the metal container doors 13 and 14 in their closed positions. It will be noted that the edge of the metal door 14 is disposed closely adjacent the sensor 12. A gasket or seal on the door 14 may actually engage the sensor 12.

Figure 2:
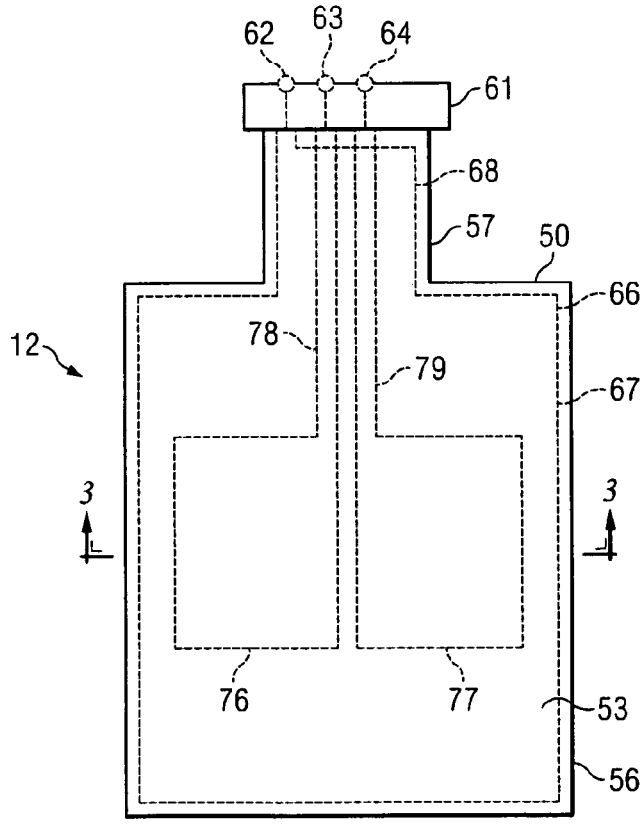
FIG. 2 is a diagrammatic view of the sensor of FIG. 1.
Figure 3:
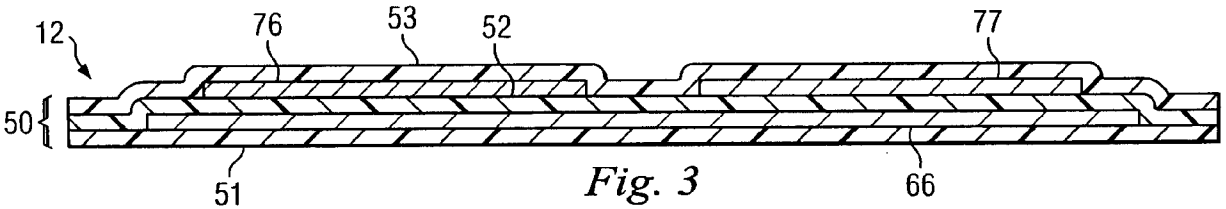
FIG. 3 is a diagrammatic sectional view of the sensor, taken along the section line 3-3 in FIG. 2.

FIG. 2 is a diagrammatic view of the sensor 12. The sensor 12 is flexible, and is shown in FIG. 2 in an approximately flat or planar state, in order to facilitate an understanding of the structure of the sensor 12. FIG. 3 is a diagrammatic sectional view of the sensor 12, taken along the section line 3-3 in FIG. 2. The sensor 12 has a flexible casing 50 made of an insulating material. More specifically, the flexible casing 50 is defined by three layers 51-53 that are each made of the insulating material. In the disclosed embodiment, the insulating layers 51-53 are each made from a commercially-available tape that has an adhesive on one side thereof, which is the lower side of each layer in FIG. 3. This tape is commercially available under the trademark KAPTON® from E.I. DuPont De Nemours and Company Corporation of Wilmington, Del. This tape has a polyimide film, with a silicone adhesive on one side of the film. The polyimide film and silicone adhesive are heat resistant, and can be used over a wide operational temperature range, for example up to a temperature of 260° C.

As shown in FIG. 2, the casing 50 has a main portion 56 that is approximately rectangular, and has an extension portion 57 that projects outwardly from one end of the main portion 56. The extension portion 57 has a width that is less than the width of the main portion 56. An electrical connector 61 is mounted to the outer end of the extension portion 57 of the flexible casing 50. The electrical connector 61 has three electrical contacts or terminals, which are shown diagrammatically at 62-64 in FIG. 2.

The sensor 12 includes a ground plane 66 in the form of a thin sheet of copper that is disposed between the insulating layers 51 and 52. The ground plane 66 is thin and flexible. In the disclosed embodiment, the ground plane 66 has a thickness in the range of about 0.0007 inch to 0.0028 inch. Although the disclosed ground plane 66 is relatively thin, this is specifically to achieve its flexibility. In an alternative embodiment, the ground plane would not be flexible, and in that case the ground plane would not need to be thin, and could have any suitable and convenient thickness.

As shown in FIG. 2, the ground plane 66 of the disclosed embodiment has an overall shape similar to that of the casing 50, including a rectangular main portion 67 and an extension portion 68. However, the ground plane 66 has width and length dimensions that are slightly smaller than those of the casing 50. The portions of the casing 50 that extend laterally beyond the edges of the ground plane 66 help to electrically isolate the ground plane 66 from structure external to the sensor 12. At the outer end of the extension portion 68, the ground plane 66 has a short, narrow strip that is electrically coupled to the electrical contact 62.

The sensor 12 further includes two electrically conductive copper plates 76 and 77 that are generally rectangular, that are spaced a small distance from each other, and that are disposed between the insulating layers 52 and 53. In the disclosed embodiment, the plates 76 and 77 each have a thickness in the range of about 0.0007 inch to 0.0028 inch. It is advantageous for the plates 76-77 to be relatively thin, because as the thickness of the plates is reduced, there is a reduction in the capacitance between the plates that is not related to the intended sample volume. The plates 76 and 77 are disposed approximately in a center region of the main portion 56 of the casing 50. Each of the plates 76 and 77 has a narrow strip 78 or 79 that extends to the outer end of the extension portion 57 of the casing 50. The strips 78 and 79 are respectively electrically coupled to the terminals 63 and 64 of the connector 61. From an electrical perspective, the spaced plates 76 and 77 effectively define a capacitor.

Figure 4:
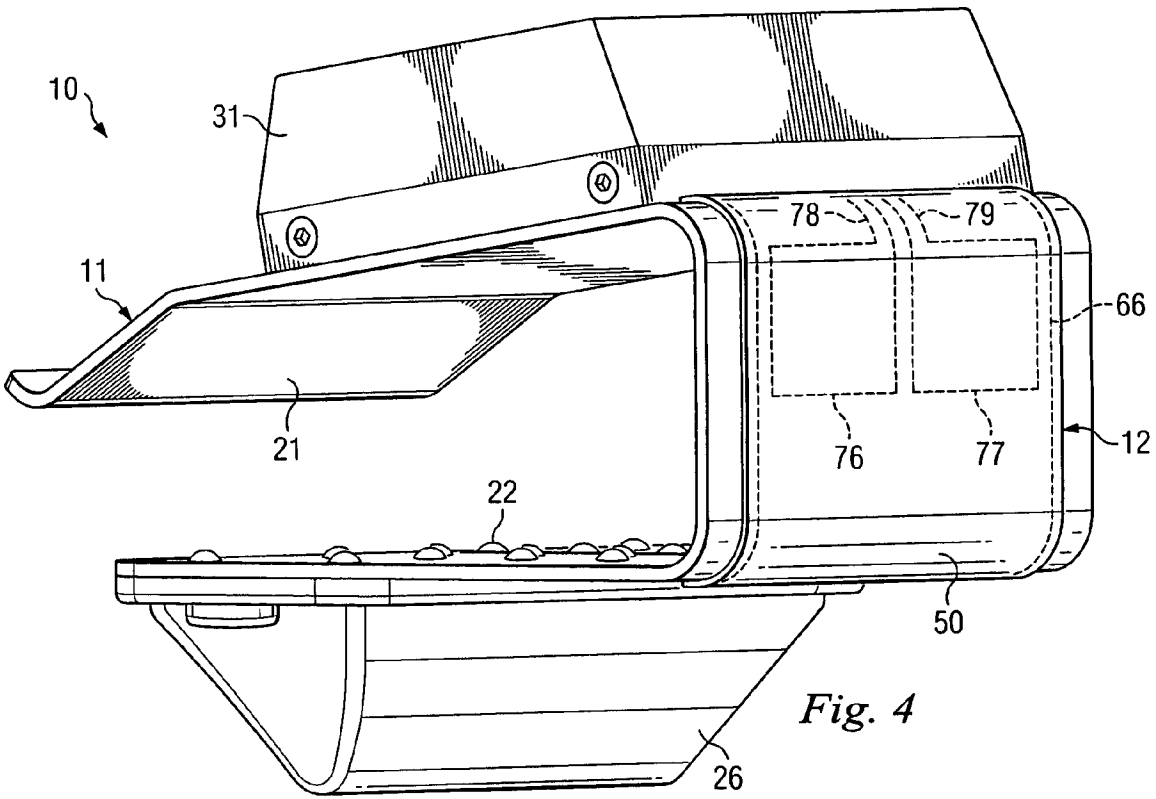
FIG. 4 is a diagrammatic perspective view of the tag and sensor of FIG. 1.
Figure 5:
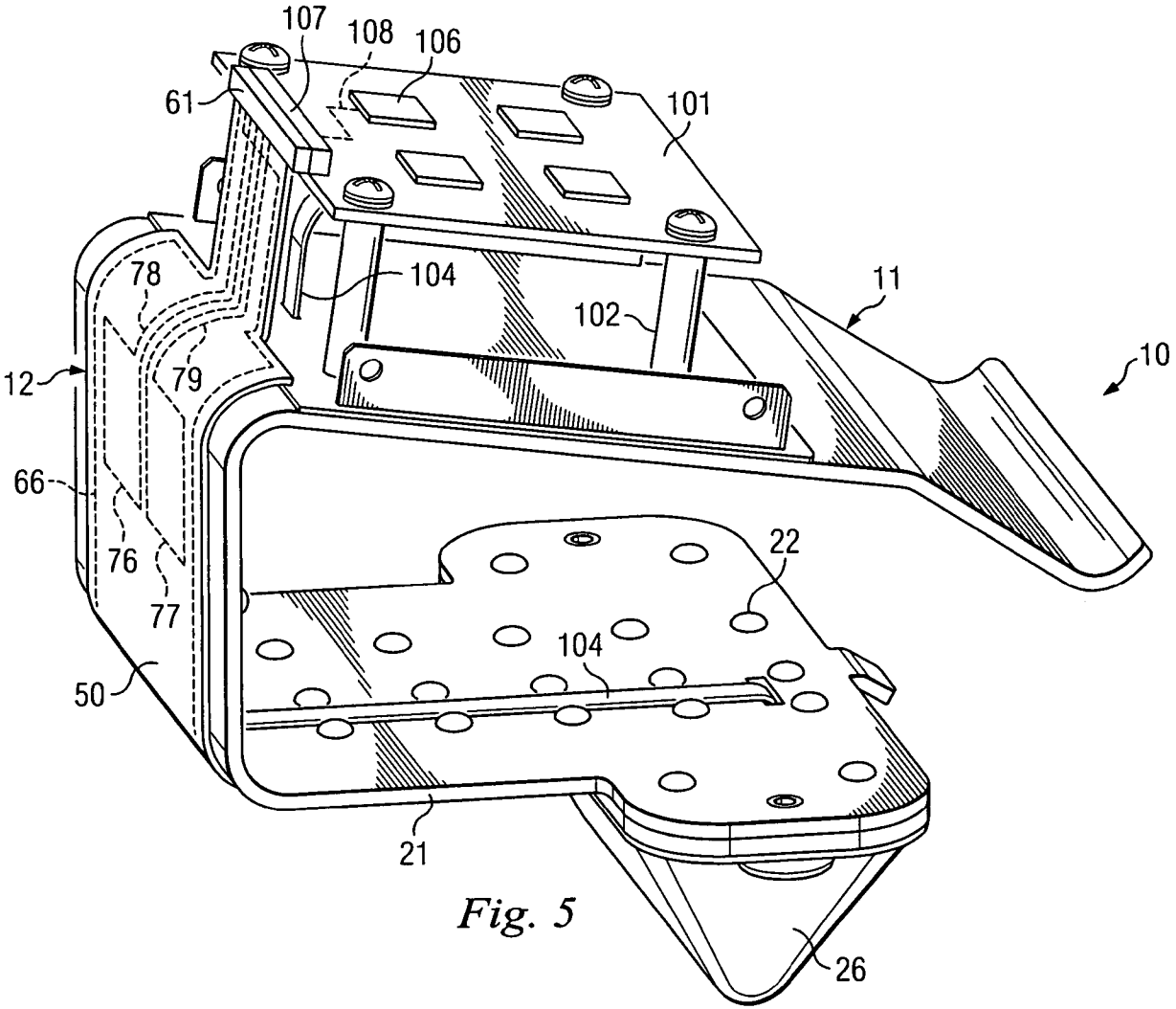
FIG. 5 is a different diagrammatic perspective view of the tag and sensor of FIG. 1, with an outer housing of a control module omitted so that certain structure within the control module is visible.

FIG. 4 is a diagrammatic perspective view of the tag 11 and the sensor 12. FIG. 5 is a further diagrammatic perspective view of the tag 11 and sensor 12, taken from a different direction, and with an outer housing of the control module omitted so that certain structure within the control module is visible. More specifically, there are four posts or standoffs 102 that each have one end fixedly coupled to the support clip 21. A circuit board 101 is secured to the opposite ends of the posts 102.

A ribbon cable 104 has one end coupled to the circuit board 102, extends through an opening in one leg of the support clip 21, and then extends along the inner surface of the support clip 21. The ribbon cable 104 is adhesively secured to this inner surface, but could alternatively be held in place in any other suitable manner. The ribbon cable 104 then passes through an opening in a further leg of the support clip 21, and into the wireless communication module 26. Thus, the ribbon cable 104 electrically couples the control circuit on the circuit board 101 to the antenna and any other circuitry disposed within the wireless communication module 26.

The circuit board 101 has control circuitry thereon, including an integrated circuit 106. In the disclosed embodiment, the integrated circuit 106 is a 24-bit sigma-delta capacitance-to-digital converter that is available commercially as part number AD7745 from Analog Devices, Inc. of Norwood, Mass. An electrical connector 107 is mounted to the circuit board 101 at one edge thereof, and is electrically coupled to the integrated circuit 106 by several runs or traces on the circuit board 101, as indicated diagrammatically by a broken line at 108.

As discussed above in association with FIG. 3, the insulating layer 51 is made from an electrically non-conductive tape that has an adhesive on one side, which is the bottom side thereof in FIG. 3. Referring again to FIGS. 4 and 5, this adhesive on the insulating layer 51 secures the sensor 12 to the C-shaped support clip 21. The main portion 56 of the flexible casing 50 has a center region secured to the bight of the clip 21, with opposite ends of the main portion 56 each extending around a curved portion of the clip 21 where the bight merges into the legs.

With reference to FIGS. 1 and 4-5, the capacitive plates 76 and 77 are positioned so that, when the container doors 13 and 14 are both closed, an edge of the metal container door 14 will be closely adjacent the capacitive plates 76 and 77. As best seen in FIGS. 1 and 4, the main portion 56 of the casing 50 has one edge that extends into the control module 31, in particular by extending between the support clip 21 and an edge of the housing of the control module 31. The extension portion 57 of the casing 50 then extends upwardly toward the circuit board 101, where the electrical connector 61 on the extension is operatively engaged with the electrical connector 107 on the circuit board. Thus, the ground plane 66 and the capacitive plates 76 and 77 are each electrically coupled to the integrated circuit 106.

In operation, the integrated circuit 106 supplies an electrical signal to the capacitive plate 76, and this signal is then capacitively coupled from the plate 76 to the plate 77. The integrated circuit 106 can measure the strength of the signal that is capacitively induced within the plate 77. When the metal door 14 (FIG. 1) is in its closed position adjacent the capacitive plates 76 and 77, it influences the capacitive coupling between the plates 76 and 77 in a manner so that more energy is capacitively coupled from the plate 76 to the plate 77 than when the door 14 is in its open position spaced from the plates. Consequently, by monitoring the strength of the signal induced within the plate 77, the integrated circuit 106 can determine whether the door 14 is closed or open.

In more detail, the integrated circuit 106 has a built-in excitation source. The capacitive plate 76 is electrically coupled to and driven by the excitation source, and the other capacitive plate 77 is coupled to an input of the sigma-delta converter. As mentioned earlier, the door 14 has a gasket secured to the edge thereof and, when both doors are closed, the gasket on the door 14 is in close proximity to both capacitive plates 76 and 77. The combination of dielectric and conductive properties of the gasket and the metal of the door 14, when located proximate to the two capacitive plates 76-77, increases the capacitance between the plates. When the door 14 is opened, the gasket and metal of the door 14 move away from the two capacitive plates 76 and 77, thereby decreasing the capacitance between these plates.

The sensing electronics in the integrated circuit 106 can measure small values of capacitance between the two conductive capacitor plates 76-77 (less than 1 picofarad), while tolerating larger shunt capacitances between either of the plates 76-77 and the ground plane 66. The ground plane 66 effectively shields the capacitance measured between the capacitor plates 76-77 from all conductive or dielectric substances on the side of the ground plane opposite from the capacitive plates. The capacitance measured between the two capacitive plates 76-77 is thus indicative of the configuration of conductive and dielectric material currently located within a sample space or sample volume that is disposed on the same side of the ground plane 66 as the two capacitive plates. This facilitates use of the disclosed sensor 14 in applications where it is mounted on a metal object such as the door 13 of an ISO container, because this configuration minimizes any impact that the metal object might have on measurement of the capacitance between the two capacitor plates 76 and 77. The effective capacitance between each of the plates 76-77 and the ground plane 66 shunts the desired capacitive effect produced within the intended sample volume on the other physical side of the plates 76-77. An actual implementation exhibited a 3000:1 signal-to-noise ratio between the door open and door closed states, and was also able to reliably detect a state in which a door was partially open.

Assume that the container is in transit, and that its doors 13 and 14 are supposed to remain closed throughout the trip. Further, assume that the sensor 12 detects that one of the doors 13 and 14 has been opened. In response to detection by the sensor 12 that one of the doors has been opened, the tag 11 can transmit a radio signal 27 to a not-illustrated receiver of a known type that is disposed at a remote location. The radio signal 27 would indicate that one of the doors 13 and 14 was opened at a time when it was supposed to be closed. Appropriate action can then promptly be taken.

The disclosed door sensor 12 has no moving parts, and this offers certain advantages in comparison to pre-existing mechanical door sensors. For example, as mentioned earlier, mechanical door sensors typically have at least one part (such as a shaft or plunger) that moves when a container door is opened or closed. In some applications, the moving part has to be hermetically sealed where it enters an enclosure containing sensing electronics. Vandals or terrorists may attempt to defeat a mechanical sensor by locking the moving part in place, for example with an epoxy adhesive, or a drill bit. If the movable part is no longer able to move, it cannot detect a situation where a door is opened.

In contrast, the disclosed capacitive door sensor 12 has no moving parts, and is more difficult to defeat. The capacitive sensor 12 measures the bulk properties of material within a sample space on the active side of the sensor ground plane 66, or in other words the side with the two capacitor plates 76-77. Any tampering within this sample space will necessarily affect the measured capacitance value. Consequently, attempts to mechanically defeat the capacitive door sensor 12 can change the measured capacitance, and thus result in detection of the tampering. In theory, one way to open the container door without detection by the capacitive sensor 12 would be to duplicate the bulk volumetric properties of the door gasket and the metal door 14 with something that remains in place when the door is opened. However, as noted above, the ISO door gasket is riveted to an edge of the door 14 with a metal strap that is not readily accessible from outside the container when both doors are closed. Even assuming that the gasket and strap could somehow be detached from the door 14 and then held in place near the sensor 12 while the door 14 was opened, the metal of the door 14 itself would move out of the sample space, and the sensor 12 would detect this. Any object or material slid between the door gasket and the capacitive plates 76-77 would change volumetric properties in very close proximity to the capacitive plates (i.e. the most sensitive region of the sample space), and would thus be readily detected by the sensor 12. Consequently, the disclosed capacitive door sensor 12 provides a high degree of tamper detection.

As explained above, the sensing electronics for the door sensor 12 can be implemented with an integrated circuit 106. Consequently, the disclosed door sensor 12 and associated circuitry can operate with very low power consumption, and can be manufactured with a lower cost than traditional mechanical door sensors. Although the foregoing discussion describes how the disclosed sensor 12 can be used to monitor the open or closed status of the doors of an ISO container, the disclosed sensor is not limited to this particular application, and could alternatively be used in any of a variety of other applications.

In the disclosed embodiment, the sensor 12 is implemented with several insulating layers 51-53 made of tape, with electrically conductive elements such as the ground plane 66 and plates 76-77 disposed between the insulating layers. However, it would alternatively be possible to implement the sensor 12 using technology known in the art as a flat flexible cable (FFC). Such a FFC would have thin layers of a conductive material such as copper laminated between insulating layers of an insulating material such as a polyimide. An suitable adhesive of a type known in the art could be provided on one side of the FFC to secure it to the tag 11.

Also, in the disclosed embodiment, the C-shaped clip 21 is made of metal and the sensor 12 is mounted on the outer side of the clip. However, it would alternatively be possible to make the clip 21 of a non-conductive material that is not significantly polar, such as a suitable plastic, and in that case the sensor 12 could be mounted on the inner side of the clip. In that configuration, the plates 76-77 would be located between the clip and the ground plane 66. Stated differently, the ground plane 66 would be between the plates 76-77 and the metal door on which the clip 21 is mounted.

Although a selected embodiment has been illustrated and described in detail, it should be understood that a variety of substitutions and alterations are possible without departing from the spirit and scope of the present invention, as defined by the following claims.

What is claimed is:

1. An apparatus comprising a sensor that includes:
an electrically conductive ground member;
electrically conductive first and second parts spaced from and proximate to each other and said ground member; and
an insulator disposed between said ground member and said first and second parts;
wherein said insulator includes a sheet of insulating material having first and second surfaces on opposite sides thereof;
wherein said ground member is sheetlike and engages said first surface;
wherein said first and second parts are sheetlike and engage said second surface; and
wherein said sensor includes two further sheets of insulating material that have therebetween said ground member, said insulator and said first and second parts.

2. An apparatus comprising a sensor that includes:
an electrically conductive ground member;
electrically conductive first and second parts spaced from and proximate to each other and said ground member; and
an insulator disposed between said ground member and said first and second parts;
wherein said insulator includes a sheet of insulating material having first and second surfaces on opposite sides thereof;
wherein said ground member is sheetlike and engages said first surface;
wherein said first and second parts are sheetlike and engage said second surface; and
wherein said ground member, said insulator and said first and second parts are flexible.

3. An apparatus comprising a sensor that includes:
an electrically conductive ground member;
electrically conductive first and second parts spaced from and proximate to each other and said ground member; and
an insulator disposed between said ground member and said first and second parts;
wherein said insulator includes a sheet of insulating material having first and second surfaces on opposite sides thereof;
wherein said ground member is sheetlike and engages said first surface;
wherein said first and second parts are sheetlike and engage said second surface;
wherein said sensor includes electrical connector structure having first and second contacts that are respectively electrically coupled to said first and second parts; and
wherein said electrical connector structure has a third contact that is electrically coupled to said ground member.

4. An apparatus according to claim 3, wherein said sensor includes first, second and third electrically conductive strips that respectively extend from said first, second and third contacts to said first part, said second part and said ground member; and wherein said ground member, said insulator, said strips and said first and second parts are all flexible.

5. An apparatus according to claim 4, wherein said first, second and third strips are respectively integral with said first part, said second part and said ground member.

6. An apparatus comprising a sensor that includes:
an electrically conductive ground member;
electrically conductive first and second parts spaced from and proximate to each other and said ground member;
an insulator disposed between said ground member and said first and second parts; and
a tag having circuitry therein that is electrically coupled to said first and second parts.

7. An apparatus according to claim 6,
wherein said insulator includes a sheet of insulating material having first and second surfaces on opposite sides thereof;
wherein said ground member is sheetlike and engages said first surface; and
wherein said first and second parts are sheetlike and engage said second surface.

8. An apparatus according to claim 6, wherein said sensor includes electrical connector structure having first and second contacts that are respectively electrically coupled to said first and second parts.

9. An apparatus according to claim 6, wherein said ground member is electrically coupled to said circuitry.

10. An apparatus according to claim 6, wherein said sensor is supported on said tag externally thereof, with said ground member located between said tag and said first and second parts.

11. An apparatus according to claim 10, including a container having a movably supported metal door, said tag being supported on said container so that, as said door moves from a first position to a second position, a portion of said door moves from a position in proximity to said sensor to a position spaced from said sensor.

12. An apparatus according to claim 11, wherein said container has a further movably supported door, said tag being supported on said further door.

13. An apparatus according to claim 6, wherein said sensor is a proximity sensor for detecting metal.

14. An apparatus comprising:
a tag having circuitry; and
a sensor supported on said tag and having electrically conductive first and second parts that are spaced from and proximate to each other, said first and second parts each being electrically coupled to said circuitry; and
a container having a movably supported metal door, said tag being supported on said container so that, as said door moves from a first position to a second position, a portion of said door moves from a position adjacent said sensor to a position spaced from said sensor.

15. An apparatus according to claim 14, wherein said container has a further movably supported door, said tag being supported on said further door.

16. An apparatus comprising:

a tag having circuitry; and a sensor supported on said tag and having electrically conductive first and second parts that are spaced from and proximate to each other, said first and second parts each being electrically coupled to said circuitry, wherein said sensor further includes:

an electrically conductive ground member that is spaced from and proximate to each of said first and second parts, said ground member being electrically coupled to said circuitry, and being located between said tag and said first and second parts; and an insulator disposed between said ground member and said first and second parts.

17. An apparatus according to claim 16, wherein said sensor includes two further sheets of insulating material that have therebetween said ground member, said insulator and said first and second parts.

18. A method comprising:

monitoring an electrical characteristic between electrically conductive first and second parts that are spaced from and proximate to each other and an electrically conductive ground member, where an insulator is disposed between said ground member and said first and second parts;

selecting as said insulator a sheet of insulating material having first and second surfaces on opposite sides thereof;

configuring said ground member to be sheetlike and to engage said first surface;

configuring said first and second parts to be sheetlike and to engage said second surface; and configuring said ground member, said insulator and said first and second parts to be flexible.

19. A method comprising:

monitoring an electrical characteristic between electrically conductive first and second parts that are spaced from and proximate to each other and an electrically conductive ground member, where an insulator is disposed between said ground member and said first and second parts; and electrically coupling said first and second parts to circuitry within a tag.

20. A method according to claim 19, including:

selecting as said insulator a sheet of insulating material having first and second surfaces on opposite sides thereof;

configuring said ground member to be sheetlike and to engage said first surface; and configuring said first and second parts to be sheetlike and to engage said second surface.

21. A method according to claim 19, including electrically coupling said ground member to said circuitry.

22. A method according to claim 19, wherein said first and second parts, said ground member and said insulator are respective portions of a sensor; and including supporting said sensor on said tag externally thereof, with said ground member located between said tag and said first and second parts.

23. A method according to claim 22, including providing a container having a movably supported metal door; and supporting said tag on said container so that, as said door moves from a first position to a second position, a portion of said door moves from a position in proximity to said sensor to a position spaced from said sensor.

24. A method according to claim 22, including selecting a capacitance characteristic as said electrical characteristic.

25. A method comprising:

providing a tag with a sensor thereon, said sensor being a proximity sensor for detecting metal, and having electrically conductive first and second parts that are spaced from and proximate to each other and that are electrically coupled to circuitry within said tag; and monitoring an electrical characteristic between said electrically conductive first and second parts using said circuitry in said tag.

26. A method according to claim 25, including configuring said sensor to have an electrically conductive ground member and an insulator, said first and second parts being spaced from and proximate to said ground member, and said insulator being disposed between said ground member and said first and second parts.

27. A method according to claim 25, including selecting a capacitance characteristic as said electrical characteristic.

28. A method according to claim 25, wherein said providing said tag includes:

configuring said tag to have an approximately C-shaped clip with two spaced legs and a bight extending between the legs; and supporting said sensor on an outer side of said bight of said clip.

29. A method comprising:

providing a tag with a sensor thereon, said sensor having electrically conductive first and second parts that are spaced from and proximate to each other and that are electrically coupled to circuitry within said tag;

monitoring an electrical characteristic between said electrically conductive first and second parts using said circuitry in said tag;

providing a container having a movably supported metal door; and supporting said tag on said container so that, as said door moves from a first position to a second position, a portion of said door moves from a position adjacent said sensor to a position spaced from said sensor.

30. A method comprising:

providing a tag with a sensor thereon, said sensor having electrically conductive first and second parts that are spaced from and proximate to each other and that are electrically coupled to circuitry within said tag;

monitoring an electrical characteristic between said electrically conductive first and second parts using said circuitry in said tag; and configuring said sensor to have:

an electrically conductive ground member that is spaced from and proximate to each of said first and second parts, said ground member being electrically coupled to said circuitry, and being located between said tag and said first and second parts; and an insulator disposed between said ground member and said first and second parts.

31. An apparatus comprising:

a tag having circuitry; and a sensor supported on said tag and having electrically conductive first and second parts that are spaced from and proximate to each other, said first and second parts each being electrically coupled to said circuitry, said sensor being a proximity sensor for detecting metal;

wherein said tag includes an approximately C-shaped clip having two spaced legs and a bight extending between the legs, said sensor being supported on an outer side of said bight of said clip.

* * * * *